US008678219B1

(12) United States Patent
Wang et al.

(10) Patent No.: US 8,678,219 B1
(45) Date of Patent: Mar. 25, 2014

(54) LID OPERATION ARRANGEMENT FOR CONTAINER

(71) Applicants: Xin Wang, Fuzhou (CN); Jiangqun Chen, Fuzhou (CN)

(72) Inventors: Xin Wang, Fuzhou (CN); Jiangqun Chen, Fuzhou (CN)

( * ) Notice: Subject to any disclaimer, the term of this patent is extended or adjusted under 35 U.S.C. 154(b) by 0 days.

(21) Appl. No.: 13/694,593

(22) Filed: Dec. 13, 2012

(51) Int. Cl.
*B65D 55/00* (2006.01)

(52) U.S. Cl.
USPC ..... 220/211; 220/264; 220/827; 220/908

(58) Field of Classification Search
USPC ..... 220/211, 260, 262, 264, 810, 816, 817, 220/819–823, 827, 908
See application file for complete search history.

(56) References Cited

U.S. PATENT DOCUMENTS

| | | | | |
|---|---|---|---|---|
| 5,170,904 | A * | 12/1992 | Neuhaus | 220/262 |
| 5,329,212 | A * | 7/1994 | Feigleson | 318/16 |
| 6,010,024 | A * | 1/2000 | Wang | 220/23.87 |
| 6,345,725 | B1 * | 2/2002 | Lin | 220/263 |
| 6,596,983 | B2 * | 7/2003 | Brent | 250/221 |
| 6,626,317 | B2 * | 9/2003 | Pfiefer et al. | 220/263 |
| D489,503 | S * | 5/2004 | Lin | D34/9 |
| 6,774,586 | B1 * | 8/2004 | Shih | 318/9 |
| 6,812,655 | B1 * | 11/2004 | Wang et al. | 318/3 |
| 6,857,538 | B2 * | 2/2005 | Lin | 220/830 |
| RE39,726 | E * | 7/2007 | Lin | 220/263 |
| 7,530,578 | B2 * | 5/2009 | Niemeyer et al. | 280/47.26 |
| 7,714,527 | B2 * | 5/2010 | Wang et al. | 318/480 |
| 7,781,995 | B2 * | 8/2010 | Yang et al. | 318/266 |
| 7,806,285 | B2 * | 10/2010 | Yang et al. | 220/264 |
| 7,906,921 | B2 * | 3/2011 | Wang et al. | 318/266 |
| 7,911,169 | B2 * | 3/2011 | Wang et al. | 318/480 |
| 8,129,930 | B2 * | 3/2012 | Wang et al. | 318/283 |
| 8,381,933 | B2 * | 2/2013 | Wang et al. | 220/211 |
| 2002/0030053 | A1 * | 3/2002 | Copeland | 220/253 |
| 2003/0201265 | A1 * | 10/2003 | Lin | 220/254.3 |
| 2006/0196874 | A1 * | 9/2006 | Yang | 220/211 |
| 2006/0255033 | A1 * | 11/2006 | Yang et al. | 220/211 |
| 2007/0266637 | A1 * | 11/2007 | McGowan | 49/349 |
| 2009/0057317 | A1 * | 3/2009 | Wang et al. | 220/495.06 |
| 2010/0139071 | A1 * | 6/2010 | Wang et al. | 29/426.1 |
| 2011/0017735 | A1 * | 1/2011 | Wang et al. | 220/211 |

* cited by examiner

*Primary Examiner* — Anthony Stashick
*Assistant Examiner* — Ned A Walker
(74) *Attorney, Agent, or Firm* — Raymond Y. Chan; David and Raymond Patent Firm

(57) ABSTRACT

A lid operation arrangement of a container includes an automatic operated unit for automatically operating a lid panel, a foot operated unit for manually operating the lid panel, and a motorized unit operatively linked with the automatic operated unit and the foot operated unit. When the motorized unit is activated by the automatic operated unit, the motorized unit is arranged for generating a torque enhancing force to move the lid panel from the opened position to the closed position and for generating a decelerating force to move the lid panel back to the closed position from the opened position in a hydraulic manner. After the lid panel is lifted up to the opened position by the foot operated unit, the motorized unit only generates the decelerating force to move the lid panel back to the closed position from the opened position in a hydraulic manner.

23 Claims, 13 Drawing Sheets

LID OPERATION ARRANGEMENT FOR CONTAINER

BACKGROUND OF THE PRESENT INVENTION

1. Field of Invention

The present invention relates to a container, and more particularly to a lid operation arrangement for a container, wherein the lid panel is decelerated to cover at the cover opening of the container body in a hydraulic manner via a gear unit.

2. Description of Related Arts

A conventional container for storing predetermined objects, such as a trash container, usually comprises an outer container body and an inner container body disposed in the outer container body, wherein the inner container body has a receiving cavity formed therein and an opening communicated with the receiving cavity. The container further comprises a cover panel movably mounted on top of the outer container body for selectively opening and enclosing the receiving cavity for allowing the user to dispose predetermined objects into the inner container body. When the container is not in use, the receiving cavity is substantially enclosed for physically separating the objects disposed in the receiving cavity from an exterior of the container.

In a number of situations, such as when a person is holding a lot of trash in both of his hands, it is inconvenient or difficult for the person to lift up the cover panel in that the person simply does not have spare hands to lift up the cover panel. If the person nevertheless tries to lift up the cover panel, he risks dropping all the trash in his or her hands onto the floor.

Because of this deep-seated difficulty with respect to the above-mentioned conventional container, there exist several other kinds of containers in which the cover panels are mainly designed to be actuated by feet instead of hands. These containers have substantially solved the problem of inconvenient or difficult lifting of the cover panel when the user has a lot of say, trash, in his or her hands. However, they create other problems. For example, a substantially amount of force has to be applied to the paddle in order to lift up the cover panel. This may perhaps pose a certain degree of difficulty for such users as children and elderly. Moreover, since the operation of the containers is mainly relies on stepping force on the part of the user, the paddle would break very easily especially when people apply unknowingly excessive stepping force on it.

In recent years, electrically-operated containers have been developed in which the cover panel is largely driven by electrical components so as to achieve automatic opening or closing of that cover panel. For most of these electrically-operated containers, such as electrically-operated trash cans, a sensor is utilized for detecting a target movement, such as a movement of the person throwing trash, in a detection range, so that when that person stands in that detection range, the sensor will send a signal to the relevant electrical components so as to automatically lift up the cover panel, and when the user has left the detection range, the sensor will send a corresponding signal to those electrical components for automatically lowering down the cover panel so as to close the container.

Accordingly, such foot-operated container or electrically-operated container has several common drawbacks. The operation mechanism is supported between the outer and inner container bodies in order to operatively link to the cover panel. In order to keep the original size of the outer container body, a portion of the surrounding wall of the inner container must be indented to create a compartment for receiving the operation mechanism thereat. In other words, the volume of the receiving cavity of the inner container body will be reduced.

Second, it is difficult to effectively control the actual physical motion of the cover panel, especially when the cover panel is lowered down to cover the container body. More specifically, when the cover panel is pivotally moved to enclose the outer container body, the gravitational force (due to the weight of the cover panel) has largely been ignored by many so that the cover panel is usually subject to excessive force when being driven to enclose the outer container body. As a result, noise will be unavoidably generated when the cover panel hits the outer container body. It is suggested that some sort of mechanisms is required to actually controllably resist the gravitational force when the cover panel is dropped to enclose the outer container body so as to minimize the noise generated by the cover panel.

Some cited arts taught a damper mechanism for slowing the downward motion of the cover panel. For example, Yang, U.S. Pat. Nos. 7,922,024 and 7,494,021, taught a damper mechanism secured to a rear area of the base of the outer container, wherein the damper mechanism comprises an air piston reciprocately received in a damper housing for applying an opposing force against the downward motion of the cover panel, such that when the foot pedal is depressed by the foot of the user, the air piston is pushed upwardly inside the damper housing. When the force on the foot pedal is released, the weight of the cover panel will push the air piston downwardly within the damper housing for slowing the downward motion of the cover panel.

As it is mentioned above, the damper mechanism as taught by Yang is supported between the outer and inner container bodies such that the volume of the inner container body will be reduced. In addition, the damper mechanism cannot be incorporated with the electrically-operated container. Since the air piston is upwardly moved when the cover panel is driven to lift, the motorized unit of the electrically-operated container will require additional lifting power to move the air piston upwardly. In other words, it is a waste of electrical power of the battery for the electrically-operated container to operate the cover panel.

Since the cover panel is initially dropped down to its closed position by means of gravity, the cover panel cannot be pivotally lifted up more than 90 degrees, i.e. the cover panel is moved at a vertical opened position from a horizontal closed position. If the cover panel is pivotally lifted at more than 90 degrees, the cover panel cannot be dropped down by its gravitational force. Therefore, the opening angle of the cover panel must be configured lesser than 90 degrees. For enhancing the practice use of the container, the opening angle of the cover panel should be more than 90 degrees such that the user is able to easily access the receiving cavity of the inner container body and to remove the inner container body from the outer container body.

The downward motion of the cover panel is controlled by the frictional force between the air piston and the inner wall of the damper housing. Due to the wear and tear of the air piston, the frictional force between the air piston and the inner wall of the damper housing will be inevitably reduced after a period of continuous use. In other words, the opposing force will be weakened to provide the damper effect of the downward motion of the cover panel.

Furthermore, the downward motion of the cover panel is controlled by the opposing force generated by the damper mechanism. When the opposing force generated by the damper mechanism is increased, the cover panel will be dropped down slowly. In other words, when the opposing force generated by the damper mechanism is reduced, the cover panel will be dropped down quickly. It should be appreciated that the cover panel should be dropped down slowly in order to minimize the noise by the cover panel. Therefore, the opposing force generated by the damper mechanism should be increased. On the other hand, the depression force applied by the foot of the user at the foot pedal must be increased to overcome the greater opposing force generated by the damper mechanism. An excessive depression force at the foot pedal may accidentally damage the lifting rod, the damper mechanism, or even the cover panel itself. As a result, the damper mechanism as taught by Yang is not practice in use, especially is not designed for the electrically-operated container.

SUMMARY OF THE PRESENT INVENTION

The invention is advantageous in that it provides a lid operation arrangement for a container, wherein the lid panel is decelerated to cover at the cover opening of the container body in a hydraulic manner via a gear unit, so as to provide a high reliable operation of the lid operation arrangement and to prolong the service life span of the lid operation arrangement.

Another advantage of the invention is to provide a lid operation arrangement for a container, wherein the lid operation arrangement can incorporate with a foot-operated container and/or the electrically-operated container.

Another advantage of the invention is to provide a lid operation arrangement for a container, wherein the lid operation arrangement will only provide a decelerating force to the lid panel when the lid panel is moved to its closed position. In other words, the lid panel can be rapidly lifted up at its opened position and can be slowly dropped down at its closed position.

Another advantage of the invention is to provide a lid operation arrangement for a container, wherein the lid operation arrangement is effectively protected within a housing against such adverse environmental factor as excess humidity, so as to prolong a general life span of the present invention.

Another advantage of the invention is to provide a lid operation arrangement for a container, wherein the opening angle of the lid panel can be configured more than 90 degrees from its closed position to its opened position for enhancing the practice use of the container.

Another object of the present invention is to provide a lid operation arrangement for a container, which is capable of lifting the lid panel in a controlled manner so as to prevent accidental damage of the electrical components of the lid operation arrangement when the lid panel is being drive to operate.

Another advantage of the invention is to provide a lid operation arrangement for a container, wherein the lid operation arrangement is located at the rear and exterior side of the container body to maximize the volume of the receiving cavity.

Another advantage of the invention is to provide a lid operation arrangement for a container, which does not require to alter the original structural design of the container, so as to minimize the manufacturing cost of the container incorporating with the lid operation arrangement.

Another advantage of the invention is to provide a lid operation arrangement for a container, wherein no expensive or complicated structure is required to employ in the present invention in order to achieve the above mentioned objects. Therefore, the present invention successfully provides an economic and efficient solution for providing a hydraulic configuration for the lid panel to decelerate the downward motion of the lid panel when the lid panel is moved to its closed position.

Additional advantages and features of the invention will become apparent from the description which follows, and may be realized by means of the instrumentalities and combinations particular point out in the appended claims.

According to the present invention, the foregoing and other objects and advantages are attained by a container which comprises a container body having a receiving cavity and a top opening, a lid panel, and a lid operation arrangement for driving the lid panel between the opened position and the closed position.

The lid panel is pivotally coupled with the container body to pivotally move between the opened position and the closed position. At the opened position, the lid panel is pivotally and upwardly moved away from the top opening to expose the receiving cavity. At the closed position, the lid panel is pivotally and downwardly moved by gravity to cover at the top opening so as to enclose the receiving cavity.

The lid operation arrangement comprises:

an automatic operated unit which comprises a sensor supported at the container body for detecting a target movement of a user;

a foot operated unit coupled at the container body for generating an upward lifting force to move the lid panel from the closed position to the opened position; and a motorized unit operatively linked with the automatic operated unit and the foot operated unit, wherein when the motorized unit is activated by the sensor, the motorized unit is arranged for generating a torque enhancing force to move the lid panel from the opened position to the closed position and for generating a decelerating force to move the lid panel back to the closed position from the opened position in a hydraulic manner, wherein after the lid panel is lifted up to the opened position by the foot operated unit that the motorized unit is idle to generate the torque enhancing force, the motorized unit only generates the decelerating force to move the lid panel back to the closed position from the opened position in a hydraulic manner.

In accordance with another aspect of the invention, the present invention comprises a lid operation arrangement of the container which comprises:

a foot operated unit coupled at the container body for generating an upward lifting force to move the lid panel from the opened position to the closed position; and a motorized unit operatively linked with the foot operated unit, wherein the motorized unit comprises a DC power generator, a gear transmission unit which is operatively linked between the DC power generator and the lid panel for pivotally moving the lid panel, wherein after the lid panel is lifted up to the opened position by the foot operated unit, the gear transmission unit is actuated by a downward motion of the lid panel to activate the DC power generator, such that the DC power generator generates a decelerating force, which is smaller than a gravitational force of the lid panel, to decelerate the downward motion of the lid panel so as to move the lid panel back to the closed position in a hydraulic manner.

In accordance with another aspect of the invention, the present invention comprises a method of operating a container, which comprises the steps of:

(a) normally retaining the lid cover at a closed position that the lid panel is pivotally and downwardly moved by gravity to cover at a top opening of the container body so as to enclose a receiving cavity thereof;

(b) applying a depression force at a foot pedal at a bottom portion of the container body for generating an upward lifting force to move the lid panel from the closed position to an opened position that the lid panel is pivotally and upwardly moved away from the top opening to expose the receiving cavity;

(c) after releasing the depression force at the foot pedal, pivotally dropping down the lid panel by gravity to move the lid panel back to the closed position; and (d) generating a decelerating force by a DC power generator, which is smaller than a gravitational force of the lid panel, to decelerate a downward motion of the lid panel.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The present invention is a modification and improvement of the previous inventions by the inventor of the present invention. The previous inventions, including U.S. Pat. Nos. 7,750,591 and 8,129,930, successfully disclose an induction actuated container, wherein the cover panel is actuated by an automatic driving arrangement to generate a decelerating and torque enhancing force to move the cover panel between the opened and closed positions in a hydraulic manner. The present invention will improve the previous inventions to enable the cover panel of the induction actuated container being actuated manually.

Figure 1:
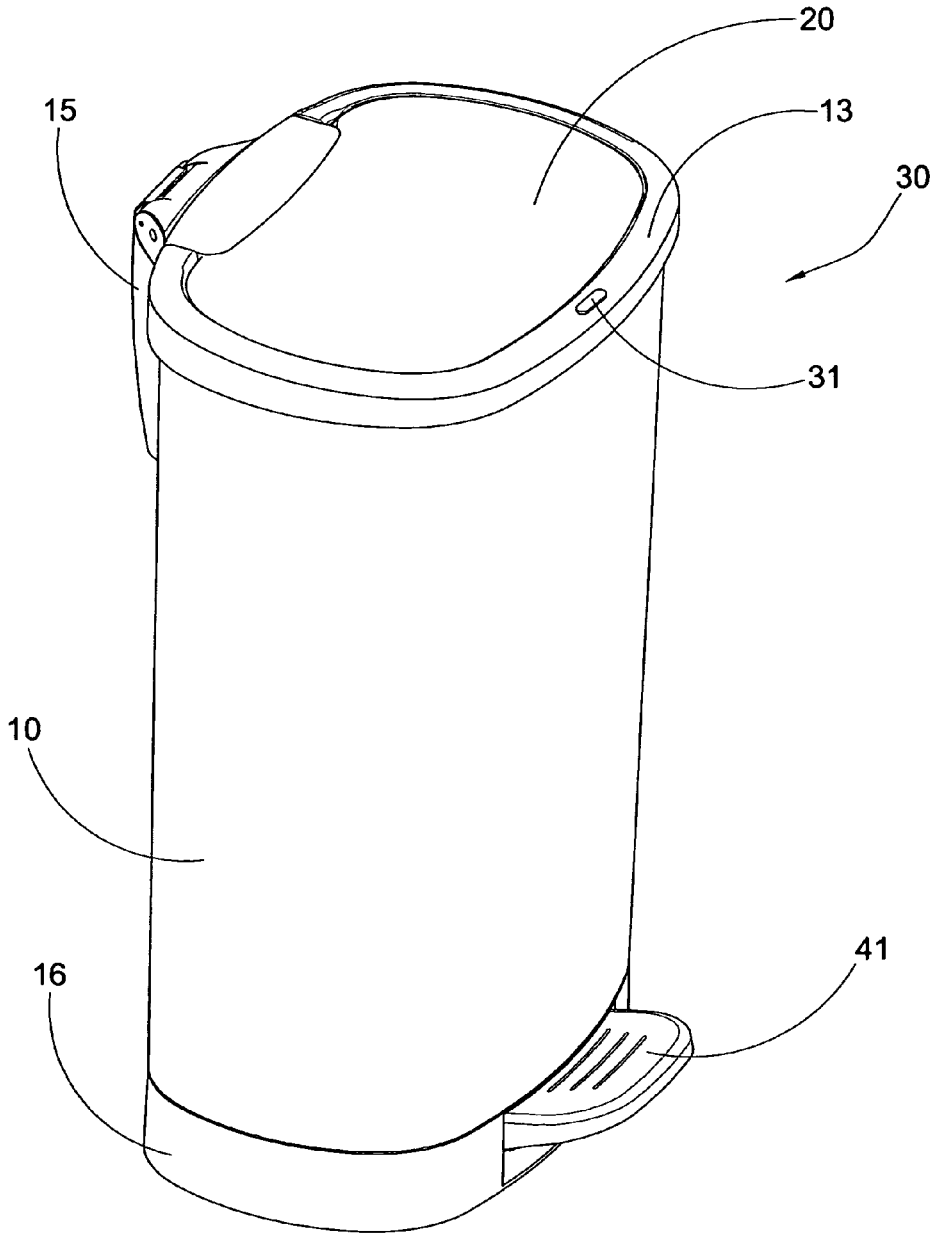
FIG. 1 is a perspective view of a container according to a first preferred embodiment of the present invention, illustrating the lid cover at a closed position.
Figure 2:
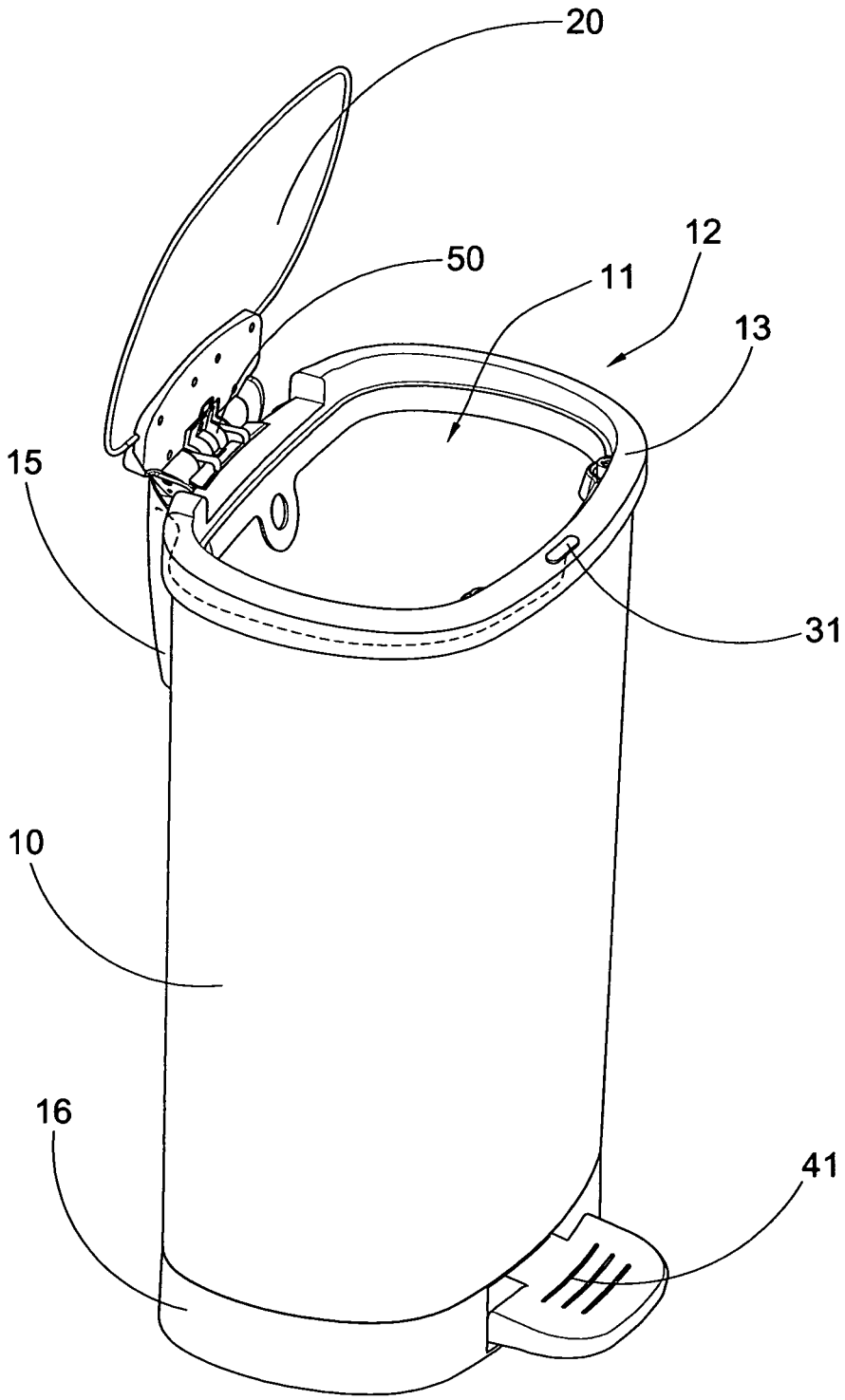
FIG. 2 is a perspective view of the container according to the above first preferred embodiment of the present invention, illustrating the lid cover at an opened position.
Figure 3:
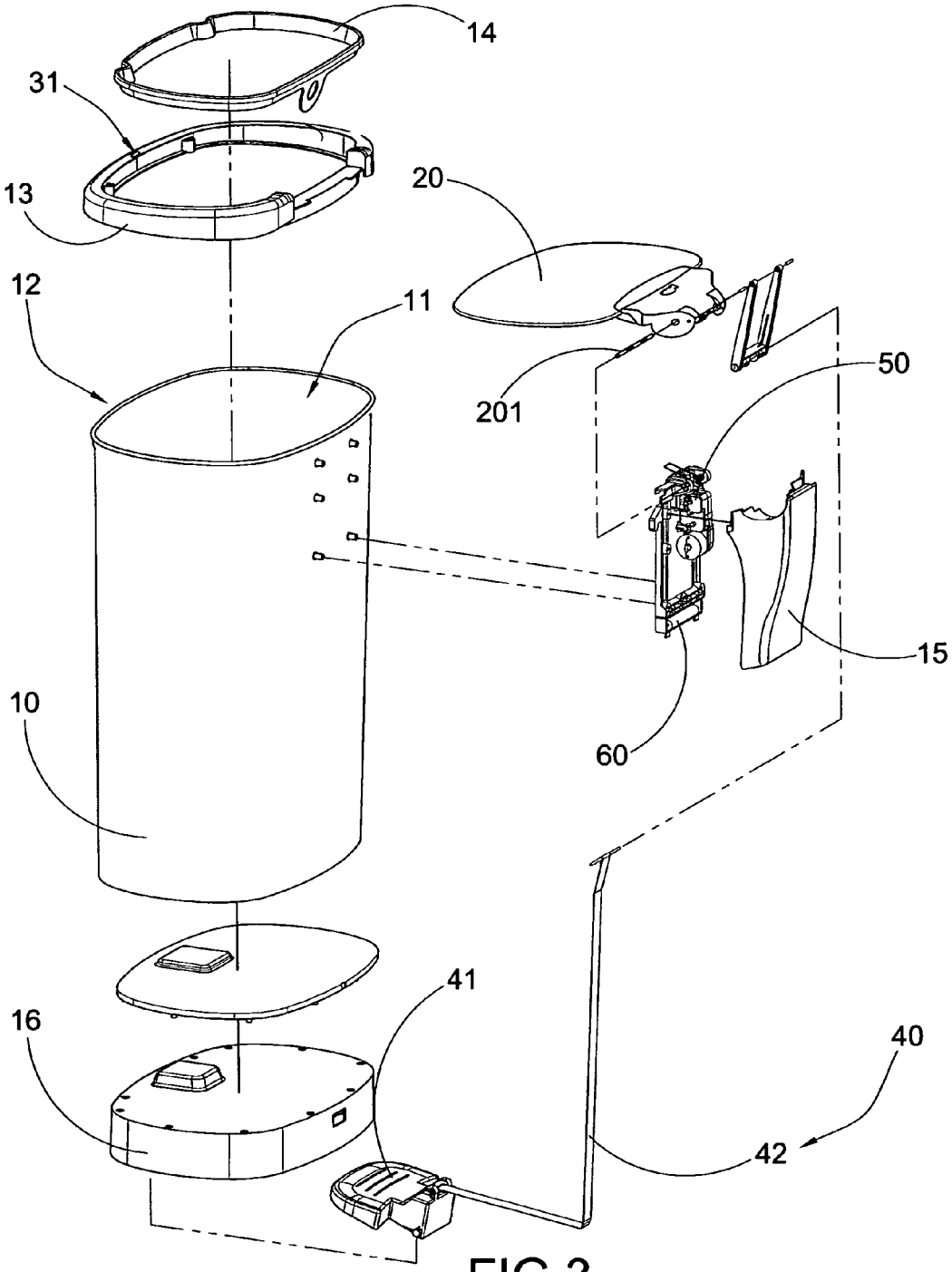
FIG. 3 is an exploded view of the container according to the above first preferred embodiment of the present invention.

Referring to FIGS. 1 to 3 of the drawings, a container according to a first preferred embodiment of the present invention is illustrated, wherein the container comprises a container body 10, a lid panel 20, and a lid operation arrangement.

The container body 10 has a receiving cavity 11 and a top opening 12, wherein the receiving cavity 11 is utilized for storing predetermined objects, such as trash, disposed by a user of the present invention. The container body 10 further comprises a retention head 13 detachably coupled at a surrounding rim of the top opening 12, wherein the retention head 13 has a ring shape such that the retention head 13 is coupled at the top opening 12 without blocking the access of the receiving cavity 12. The container body 10 further comprises a holding rim 14 detachably coupled at a surrounding rim of the retention head 13. Accordingly, when the container body 10 is used as a trash container, a trash bag can be placed at the receiving cavity 11, wherein an opening of the trash bag can be held at the top opening 12 via the holding rim 14.

The lid panel 20 is pivotally coupled with the container body 10 to pivotally move between an opened position and a closed position. At the opened position, the lid panel 20 is pivotally and upwardly moved away from the top opening 12 to expose the receiving cavity 11. At the closed position, the lid panel 20 is pivotally and downwardly moved by gravity to cover at the top opening 12 so as to enclose the receiving cavity 11.

Preferably, the lid panel 20 is pivotally coupled with the retention head 13 of the container body 10 via a pivot axle 201. In particular, the rear edge of the lid panel 20 is pivotally coupled with the rear side of the container body 10. Through the pivot axle 201, the lid panel 20 can be pivotally moved more than 90 degrees, i.e. the opening angle of the lid panel 20. In other words, at the closed position, the lid panel 20 is preferably retained at a horizontal level to cover the top opening 12 of the container body 10. At the opened position, the lid panel 20 is pivotally, rearwardly, and upwardly moved more than 90 degrees at a vertical level, wherein the center of mass of the lid panel 20 is shifted beyond the pivot axle 201.

Figure 5:
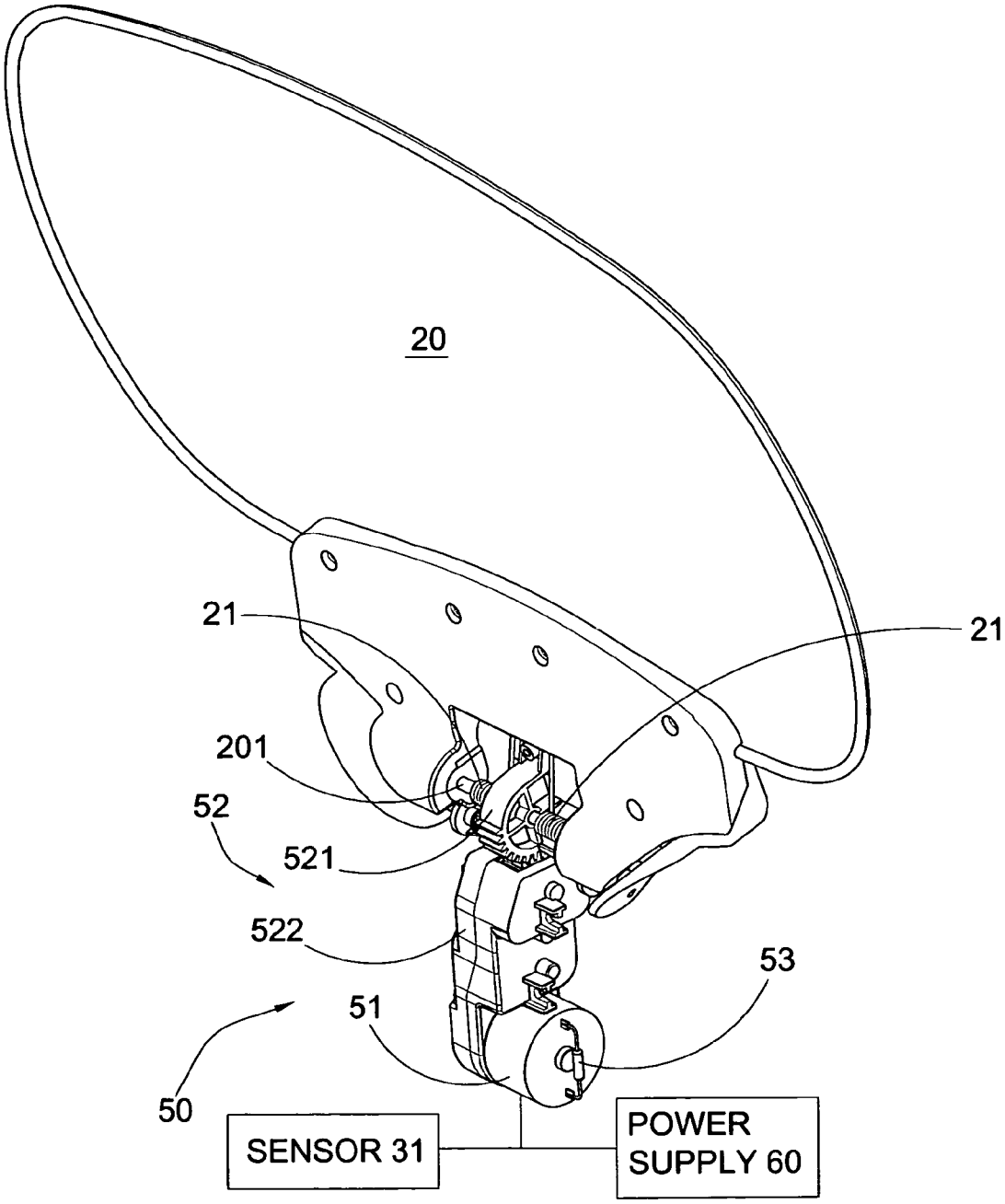
FIG. 5 is a perspective view of the lid operation arrangement of the container according to the above first preferred embodiment of the present invention.
Figure 6:
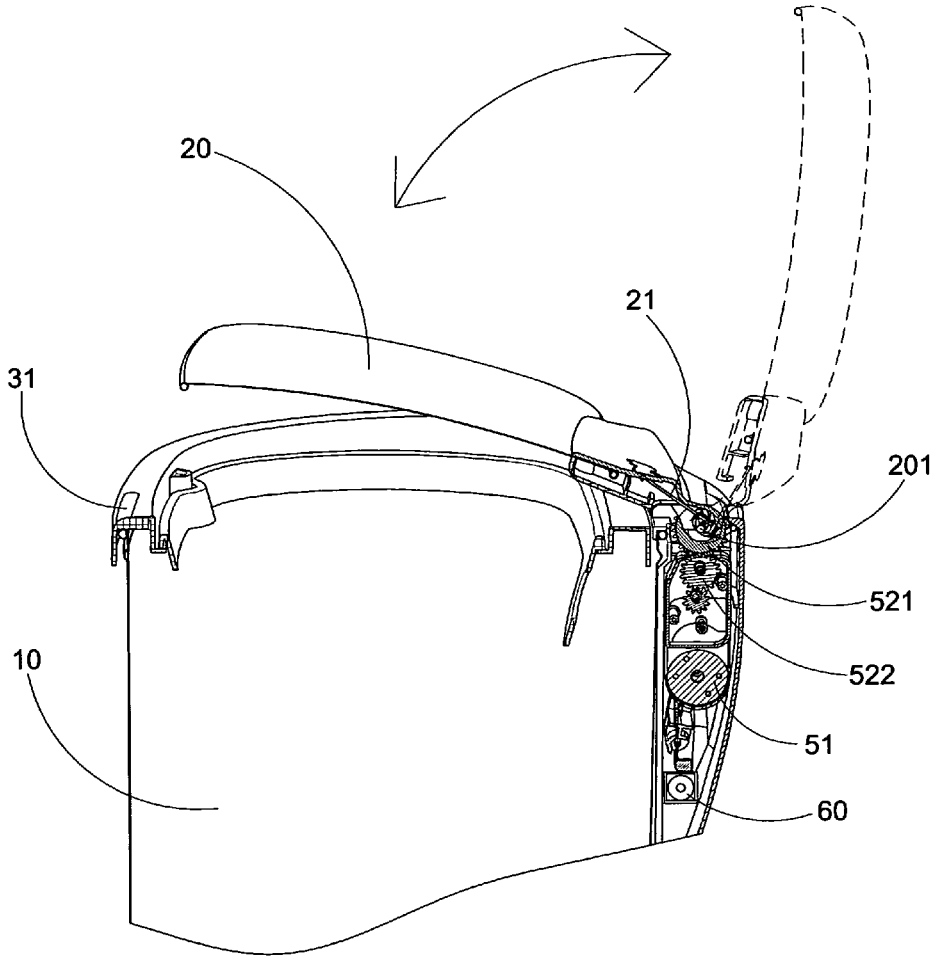
FIG. 6 is a sectional view of the lid operation arrangement of the container according to the above first preferred embodiment of the present invention.

As shown in FIGS. 5 and 6, the lid panel 20 further comprises a resilient element 21 coupled at the pivot axle 201 for applying an upward urging force against the lid panel 20 to assist the lid panel 20 being moved to the opened position and for applying a downward urging force against the lid panel 20 to assist the lid panel being moved back to the closed position. Accordingly, the resilient element 21 is a coil spring having a coil body coupled at the pivot axle 201 and two coil arms coupled at the lid panel 20 and the container body 10 respectively.

When the lid panel 20 is remained at the closed position, the coil arms of the resilient element 21 are pressed to move close to each other. Therefore, a compression spring force is restored in the resilient element 21. When the lid panel 20 is initially lifted, the compression spring force of the resilient element 21 will apply to the lid panel 20 as the upward urging force to enhance the upward motion of the lid panel 20. Once the lid panel 20 is moved at the opened position, the coil arms of the resilient element 21 are stretched to move away to each other. Therefore, a stretching spring force is restored in the resilient element 21. When the lid panel 20 is initially moved back to the closed position, the stretching spring force of the resilient element 21 will apply to the lid panel 20 as the downward urging force to enhance the downward motion of the lid panel 20. Since the center of mass of the lid panel 20 is shifted beyond the pivot axle 201, the stretching spring force of the resilient element 21 will move the center of mass of the lid panel 20 back to the pivot axle 201. Therefore, the lid panel 20 can be dropped back to the closed position by gravity. Accordingly, two coil springs are spacedly coupled at the pivot axle 201, such that two upward urging forces and two downward urging forces are respectively applied to the lid panel 20 in a balancing manner. It is worth mentioning that when the lid panel 20 incorporates with the resilient element 21, the opening angle of the lid panel 20 can be larger than 90 degrees.

According to the preferred embodiment, the lid operation arrangement comprises an automatic operated unit 30 for automatically operating the lid panel 20, a foot operated unit 40 for manually operating the lid panel 20, and a motorized unit 50 operatively linked with the automatic operated unit 30 and the foot operated unit 40. The lid operation arrangement further comprises a power supply 60 electrically linked to the automatic operated unit 30 and the motorized unit 50.

The automatic operated unit 30 comprises a sensor 31 supported at the container body 10 for detecting a target movement of a user, wherein the sensor 31 is mounted on a front portion of the container body 10 for detecting the target movement of the user. Preferably, the sensor 31 is supported at the front side of the retention head 13 at a position that the sensor 31 is located in front of the lid panel 20 to maximize the detecting range of the sensor 31 at the approaching direction for detecting the target movement, wherein the sensor 31 is operatively linked to the motorized unit 50 via a cable. The sensor 31 comprises a sensor unit and a sensor circuit operatively linked to the motorized unit 50 via the cable.

The foot operated unit 40 is coupled at the container body 10 for generating an upward lifting force to move the lid panel 20 from the closed position to the opened position. In particular, the foot operated unit 40 comprises a foot pedal 41 pivotally coupled at a bottom portion of the container body 10 and an actuation link 42 operatively connected the foot pedal 41 to the lid panel such that when the foot pedal 41 is depressed by a depression force, such as stepping on the foot pedal 41 by a foot of the user, the actuation link 42 will transmit the upward lifting force to the lid panel 20 so as to move the lid panel 20 from the opened position to the closed position. Accordingly, the container body 10 comprises a base 16 coupled at the bottom side of the container body 10, wherein the foot pedal 41 is supported in the base 16.

Figure 4:
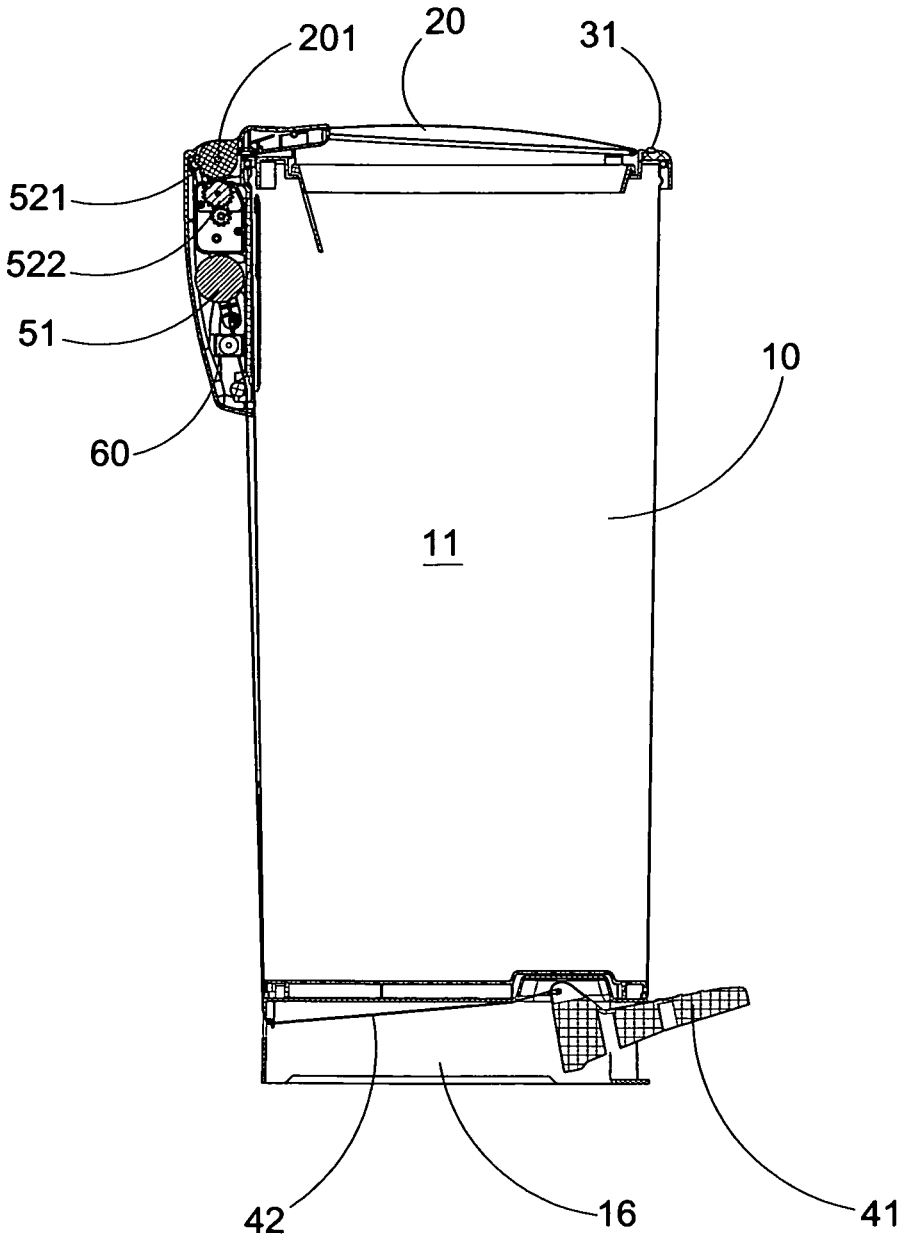
FIG. 4 is a sectional view of the container according to the above first preferred embodiment of the present invention.

Preferably, the actuation link 42 is an elongated cable having one end connected to a rear side of the foot pedal 41 and an opposed end connected to the rear edge of the lid panel 20 such that when the foot pedal 41 is depressed, the elongated cable is pulled to pivotally lift up the lid panel 20, as shown in FIG. 4. It should be appreciated that the actuation link 42 can be an elongated rod connected between the rear edge of the lid panel 20 and the foot pedal 41 to operate the lid panel 20.

The motorized unit 50 is selectively activated by the automatic operated unit 30 and the foot operated unit 40. When the motorized unit 50 is activated by the sensor 31, the motorized unit 40 is arranged for generating a torque enhancing force to move the lid panel 20 from the opened position to the closed position and for generating a decelerating force to move the lid panel 20 back to the closed position from the opened position in a hydraulic manner. After the lid panel 20 is lifted up to the opened position by the foot operated unit 40 that the motorized unit 50 is idle to generate the torque enhancing force, the motorized unit 50 only generates the decelerating force to move the lid panel 20 back to the closed position from the opened position in a hydraulic manner.

As shown in FIGS. 5 and 6, the motorized unit 50 comprises a DC power generator 51, a gear transmission unit 52 which is operatively linked between the DC power generator 51 and the lid panel 20 for controllably lifting up and dropping down the lid panel 20 at a speed determined by gear ratios of the gear transmission unit 52 so as to move the lid panel 20 between the opened and closed positions in a hydraulic manner.

According to the preferred embodiment, the DC power generator 51 is a permanent magnet DC motor which comprises an induction coil, a magnet, and an output shaft coupled to the gear transmission unit 52. In particular, when the current pass through the induction coil to induct with the magnet, the DC power generator 51 will generate a rotational power at the output shaft. Likewise, when the rotational force is applied to the output shaft, an induction current will be generated at the induction coil.

In other words, when the DC power generator 51 is activated by the sensor 31, the DC power generator 51 is electrified to generate the rotational power at the output shaft. The rotational power will be transmit to the torque enhancing force through the gear transmission unit 52 in order to pivotally lift up the lid panel 20.

The gear transmission unit 52 comprises an operation gear 521 affixed to the rear edge of the lid panel and a speed adjustable gear set 522 operatively linked between the DC power generator 51 and the operation gear 521 such that when the lid panel 20 is pivotally dropped down, the speed adjustable gear set 522 is actuated via the operation gear 521 to activate the DC power generator 51 so as to generate the decelerating force against the downward motion of the lid panel 20.

The operation gear 521 is a sector gear defining a center portion coupled at the pivot axle 201 and an arc teething surface, wherein the arc length of the arc teething surface of the operation gear 521 is long enough to move the lid panel 20 between the opened position and the closed position.

The speed adjustable gear set 522 has a plurality of gears with a predetermined gear ratio to transmit the rotational power from the DC power generator 41 to the operation gear 521.

After the lid panel 20 is actuated to pivotally lift up through the activation of the sensor 31, the lid panel 20 will be pivotally dropped down by gravity back to its closed position. During the downward motion of the lid panel 20, the speed adjustable gear set 522 is actuated at its opposite direction by the operation gear 521. Then, the output shaft is driven to rotate at the opposite direction to generate the induction current in the DC power generator 51. The induction current will generate a reverse rotational power at the output shaft such that the reverse rotational power will then be transmitted back to the operation gear 521 through the speed adjustable gear set 522 as the decelerating force against the downward motion of the lid panel 20. It is worth mentioning that the decelerating force is smaller than the gravitational force of the lid panel 20, such that the lid panel 20 will be slowly dropped back to the closed position.

It is worth mentioning that when the lid panel 20 is moved back to the closed position, the DC power generator 51 is idle that no electrical power is supplied to the DC power generator 51 from the power supple 60.

In order to ensure the operation of the motorized unit 50, the motorized unit 50 further comprises a current guider 53 operatively coupled with the DC power generator 51. The current guider 53 is an electronic element to only allow the current flowing at one direction when the lid panel 20 is actuated by the foot operated unit 40. In particular, the current guider 53 is a diode electrically coupled to the DC power generator 51.

When the lid panel 20 is actuated by the foot operated unit 40, the current guider 53 forms a current resistance to prevent the induction current being generated in the DC power generator 51, so as to enable the lid panel 20 being moved to the opened position. When the lid panel 20 is moved back to the closed position, the current guider 53 forms a current conductor to ensure the induction current being generated in the DC power generator 51 so as to generate the decelerating force against the lid panel 20.

In particular, when the lid panel 20 is lifted by the actuation of the foot pedal 41, the speed adjustable gear set 522 is driven to actuate by the operation gear 521 so as to increase the rotational speed of the output shaft. When the output shaft is driven to rotate at a relatively high speed, the DC power generator 51 is in power generation state. For example, when the lid panel is pivotally lifted at a counter clockwise direction, the voltage at two terminals of the current guider 53 is a reverse voltage. Therefore, the current guider 53 forms the current resistance such that no induction current is generated in the induction coil of the DC power generator 51. In other words, the lid panel 20 can be easily lifted up at the opened position.

Once the depression force at the foot pedal 41 is released, the lid panel 20 is pivotally dropped down to the closed position. During the downward motion of the lid panel 20, i.e. the lid panel is pivotally moved at a clockwise direction, the speed adjustable gear set 522 is driven to actuate by the operation gear 521 so as to drive the output shaft to rotate at the clockwise direction. At this moment, the voltage at two terminals of the current guider 53 is a positive voltage. Therefore, the current guider 53 forms the current conductor to enable the induction current being generated in the induction coil of the DC power generator 51. Accordingly, a torque is generated at the output shaft as the decelerating force against the lid panel 20.

According to the preferred embodiment, the user is able to selectively operate the lid panel 20 either by the automatic operated unit 40 or by the foot operated unit 50. The motorized unit 50 further comprises a switch 54 operatively coupled with the power supply 60 and arranged in such a manner that when the power supply 60 is switched on, the lid panel is operated by the automatic operated unit 30, and when the power supply 60 is switched off, the lid panel 20 is operated by the foot operated unit 40.

As shown in FIGS. 3 and 4, the power supply 60 comprises a battery compartment supported by the container body 10 for receiving a rechargeable battery or a replaceable battery. When the power supply 60 is switched off, there will be no electrical power supplying to the sensor 41 and the DC power generator 51. Therefore, the lid panel 20 will be actuated to lift up at the opened position only by the actuation of the foot pedal 41. It is worth mentioning that when there will be no electrical power supplying to the DC power generator 51, the induction current will still be generated by the downward motion of the lid panel 20 in order to generate the decelerating force against the lid panel 20. In other words, the power supply 60 will only supply the electrical power to the DC power generator 51 for generating the torque enhancing force to move the lid panel 20 from the opened position to the closed position. Even though the container of the present invention is out of battery, the user is still able to operate the lid panel 20 through the actuation of the foot pedal 41. It is worth mentioning that when the power supply 60 is switched on, the lid panel 20 can still be operated by the foot operated unit 40.

It is worth mentioning that the automatic operated unit 30, the foot operated unit 40, the motorized unit 50, and the power supply 60 of the lid operation arrangement are located out of the receiving cavity 11 of the container body 10 so as to maximize the volume of the receiving cavity 11. In particular, the motorized unit 50 and the power supply 60 are supported at the rear and exterior side of the container body 10 and are received in a housing 15 to protect the motorized unit 50 and the power supply 60.

Figure 7:
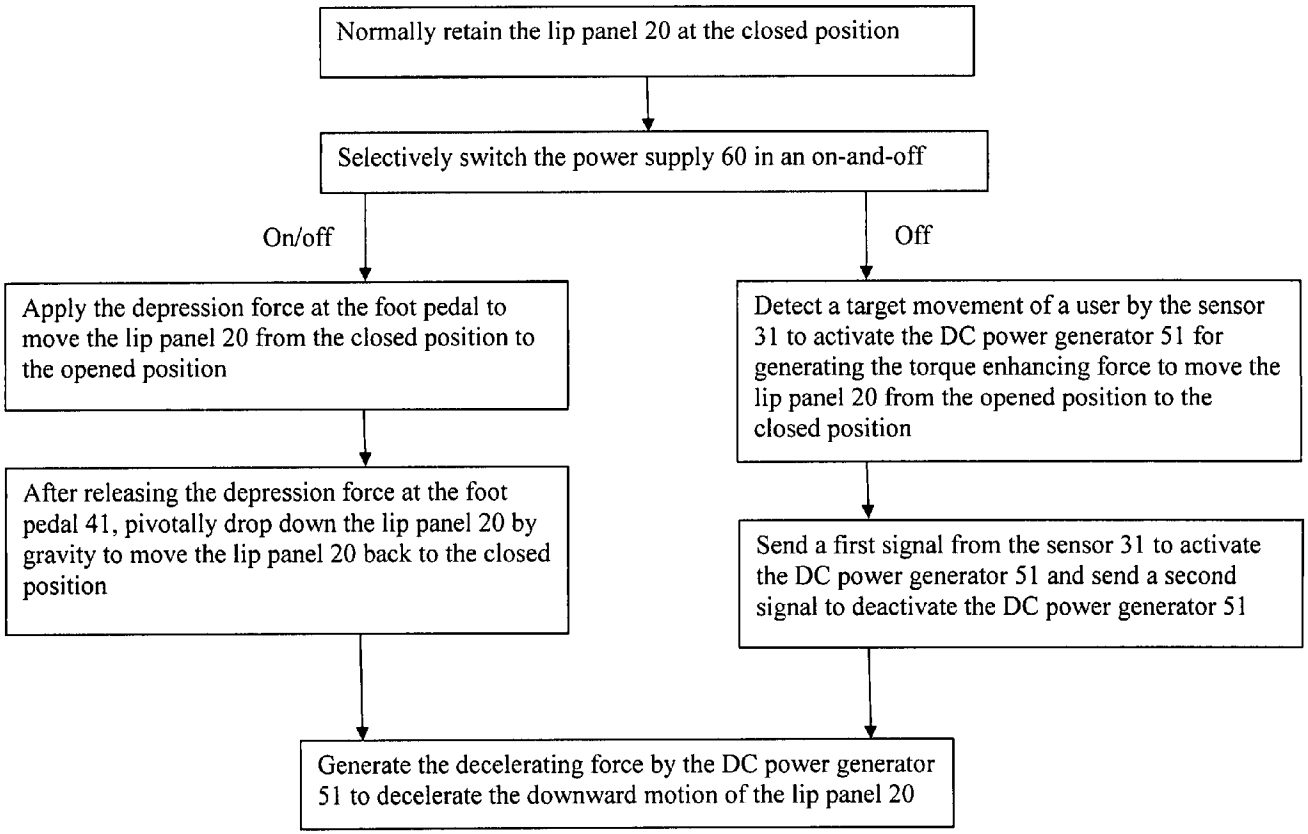
FIG. 7 is a flow diagram illustrating the operation of the lid operation arrangement of the container according to the above first preferred embodiment of the present invention.
Figure 8:
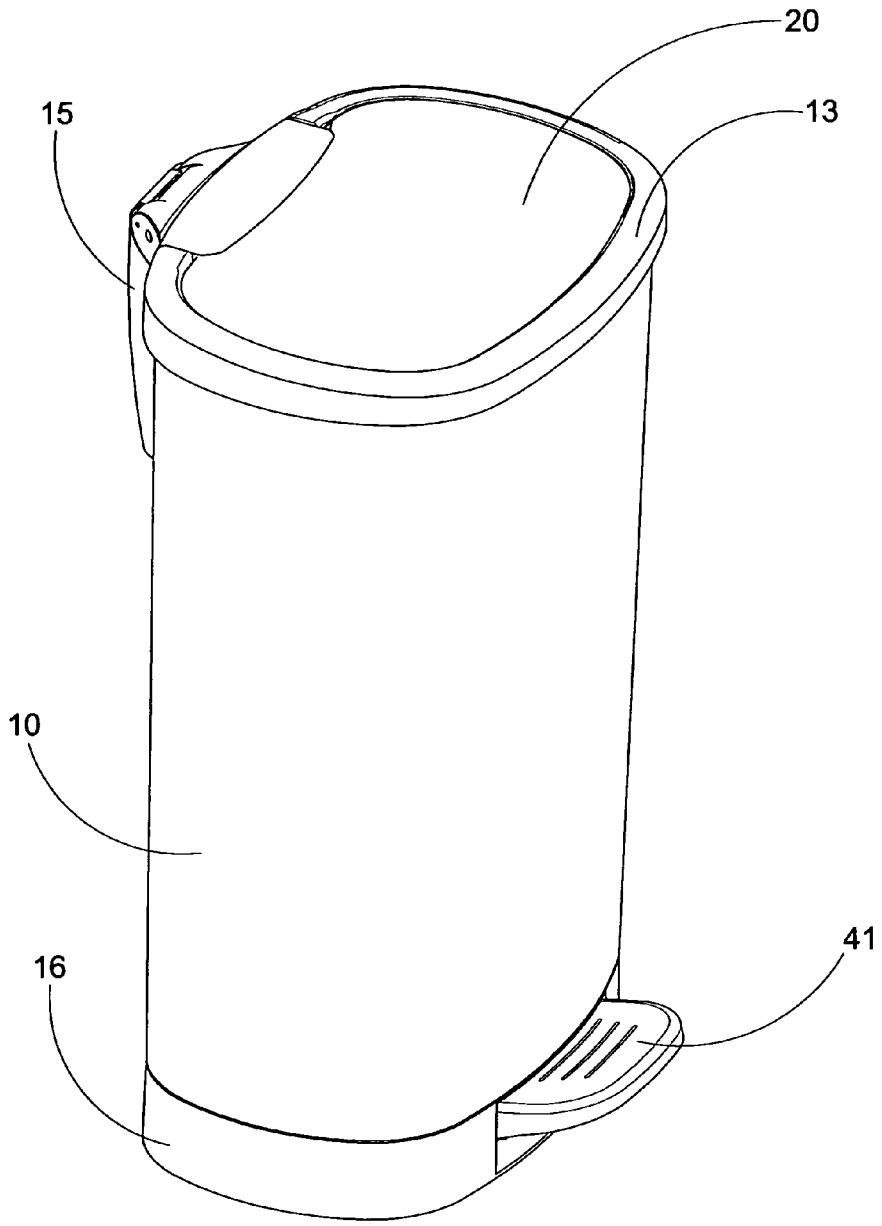
FIG. 8 is a perspective view of a container according to a second preferred embodiment of the present invention, illustrating the lid cover at a closed position.
Figure 9:
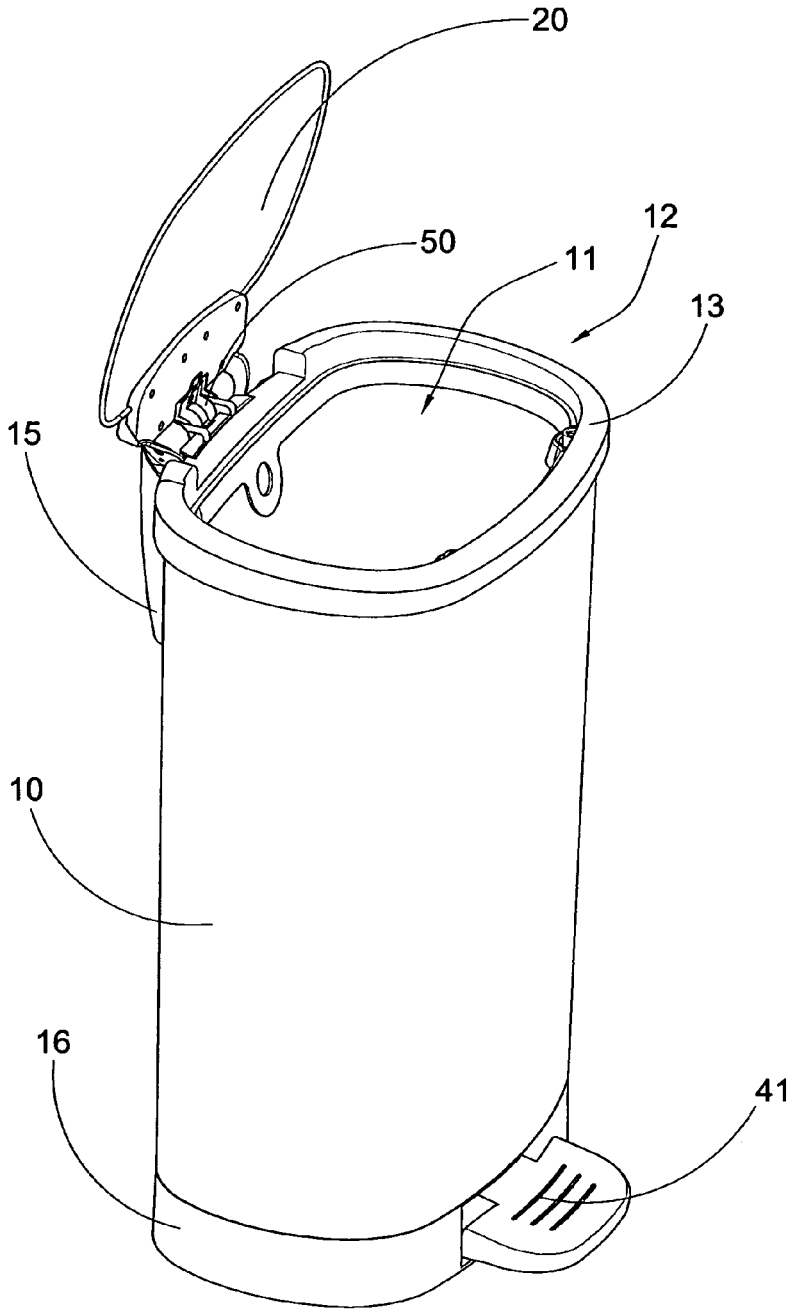
FIG. 9 is a perspective view of the container according to the above second preferred embodiment of the present invention, illustrating the lid cover at an opened position.
Figure 10:
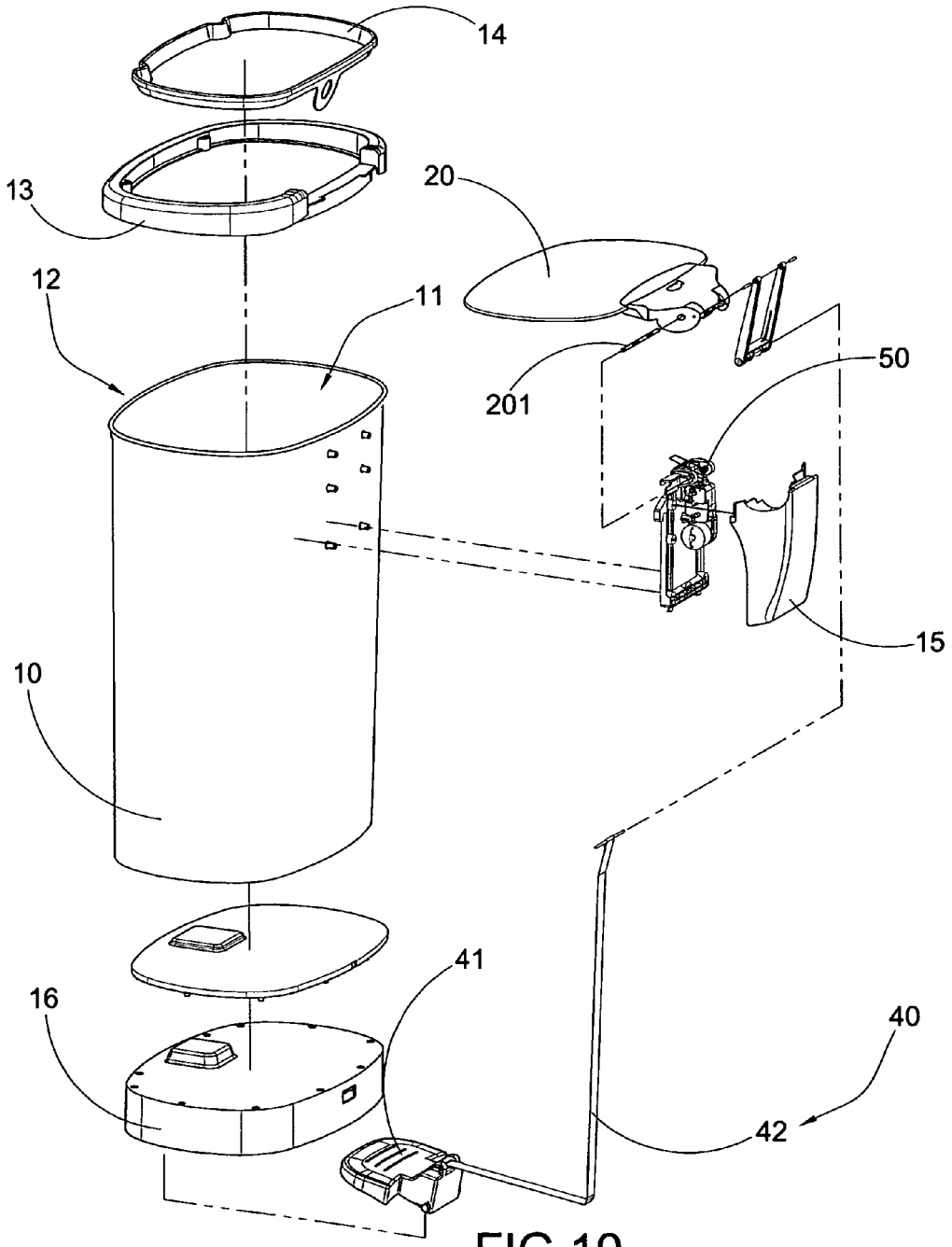
FIG. 10 is an exploded view of the container according to the above second preferred embodiment of the present invention.
Figure 11:
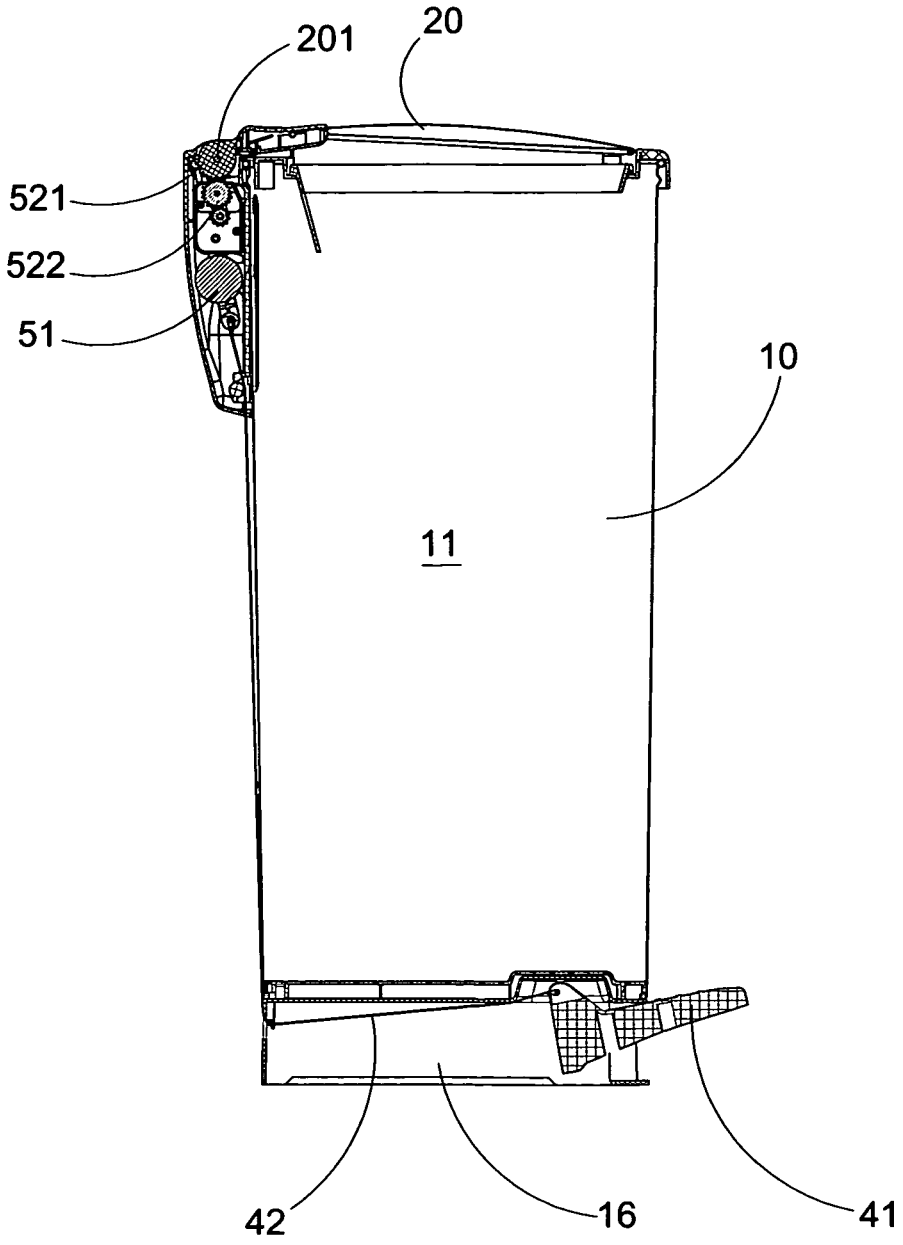
FIG. 11 is a sectional view of the container according to the above second preferred embodiment of the present invention.
Figure 12:
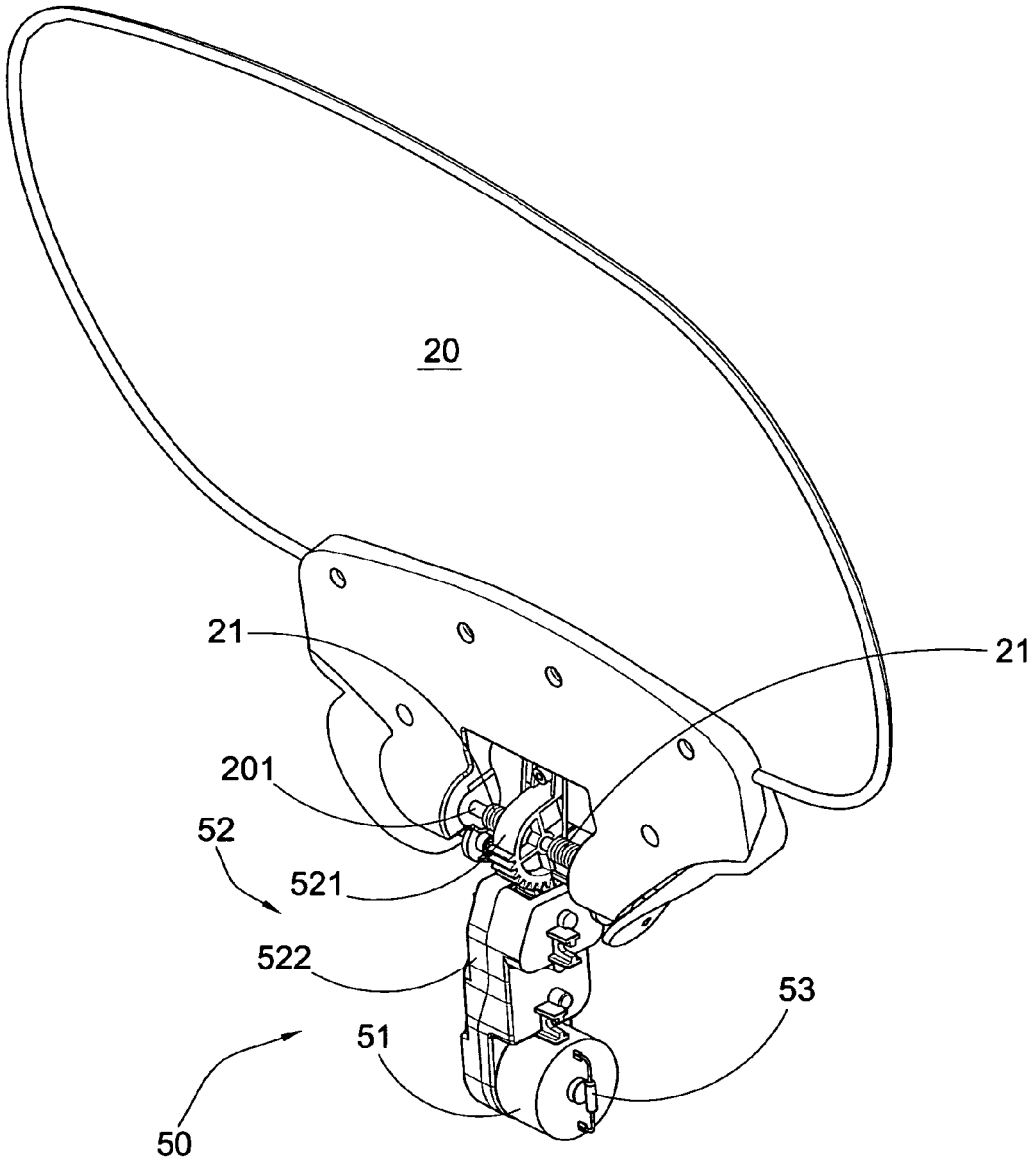
FIG. 12 is a perspective view of the lid operation arrangement of the container according to the above second preferred embodiment of the present invention.
Figure 13:
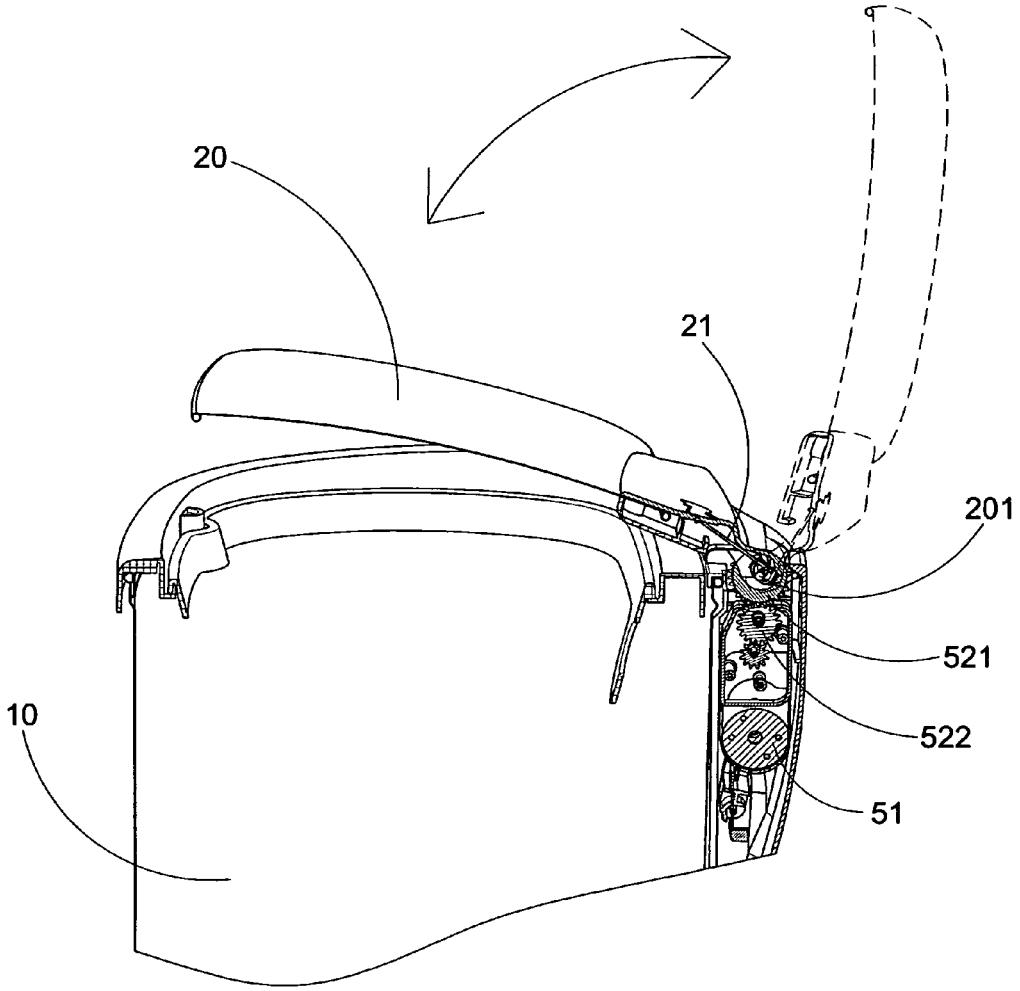
FIG. 13 is a sectional view of the lid operation arrangement of the container according to the above first preferred embodiment of the present invention.

In order to operate the container, the present invention further provides a manual operation method, as shown in FIG. 7, which comprises the following steps.

(1) Normally retain the lid panel 20 at the closed position that the lid panel 20 is pivotally and downwardly moved by gravity to cover at the top opening 12 of the container body 10 so as to enclose the receiving cavity 11 thereof.

(2) Apply the depression force at the foot pedal 41 at the bottom portion of the container body 10 for generating the upward lifting force to move the lid panel 20 from the closed position to the opened position that the lid panel 20 is pivotally and upwardly moved away from the top opening 12 to expose the receiving cavity 11. Accordingly, in the step (2), when the lid panel 20 is actuated by the foot pedal 41, the current guider 53 forms the current resistance to prevent an induction current being generated in the DC power generator 51 so as to enable the lid panel 20 being moved to the opened position.

(3) After releasing the depression force at the foot pedal 41, pivotally drop down the lid panel 20 by gravity to move the lid panel 20 back to the closed position.

(4) Generate the decelerating force by the DC power generator 51, which is smaller than the gravitational force of the lid panel 20, to decelerate the downward motion of the lid panel 20. In particular, the gear transmission unit 52 is actuated by the downward motion of the lid panel 20 to activate the DC power generator 51 in order to generate the decelerating force against the lid panel 20. In the step (4), when the lid panel 20 is moved back to the closed position, the current guider 53 forms the current conductor to ensure the induction current being generated in the DC power generator 51 so as to generate the decelerating force against the lid panel 20.

The present invention further provides an automatic operation method, as shown in FIG. 7, which comprises the following steps.

(1) Normally retain the lid panel 20 at the closed position that the lid panel 20 is pivotally and downwardly moved by gravity to cover at the top opening 12 of the container body 10 so as to enclose the receiving cavity 11 thereof.

(2') Detect a target movement of a user by the sensor 31 to activate the DC power generator 51 for generating the torque enhancing force to move the lid panel 20 from the opened position to the closed position. It is worth mentioning that the torque enhancing force is generated by the DC power generator only when the sensor is activated.

(3') Send a first signal from the sensor 31 to activate the DC power generator 51 when the user is located within the detection range of the sensor 31 and send a second signal to deactivate the DC power generator 51 when the user is located out of the detection range of the sensor 31 or after a predetermined operation time. After the DC power generator 51 is deactivated, the lid panel 20 is pivotally dropped down by gravity to move the lid panel 20 back to the closed position. It is worth mentioning that the deactivation of the DC power generator will stop the DC power generator 51 for generating the torque enhancing force. The decelerating force is generated by the DC power generator 51 in response to the induction current but not the electrical current supplied by the power supply 60.

(4) Generate the decelerating force by the DC power generator 51, which is smaller than the gravitational force of the lid panel 20, to decelerate the downward motion of the lid panel 20. In particular, the gear transmission unit 52 is actuated by the downward motion of the lid panel 20 to activate the DC power generator 51 in order to generate the decelerating force against the lid panel 20. In the step (4), when the lid panel 20 is moved back to the closed position, the current guider 53 forms the current conductor to ensure the induction current being generated in the DC power generator 51 so as to generate the decelerating force against the lid panel 20.

According to the preferred embodiment, in order to switch between the manual operation and the automatic operation of the container, after the step (1), the present invention further comprises a step of selectively switching the power supply 60 in an on-and-off manner, wherein when the battery supply 60 is switched on, the lid panel 20 is operated by the automatic operated unit 30, and when the battery supply 60 is switched off, the lid panel 20 is operated by the foot operated unit 40.

As shown in FIGS. 8 to 13, a container according to a second embodiment illustrates an alternative mode of the first embodiment. According to the second embodiment, the container is only operated manually. As it is mentioned above, the manual operation and the automatic operation of the container are individually operated by the foot operated unit 40 and the automatic operated unit 30 through the motorized unit 50. It should be appreciated that the container can only be operated by the foot operated unit 40.

As shown in FIGS. 8 to 13, the container of the second embodiment does not include the automatic operated unit 30 and the power supply 60. In other words, the lid operation arrangement only comprises the foot operated unit 40 and the motorized unit 50. Therefore, the operation of the container of the second embodiment is the same as the manual operation method of the first embodiment.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A container, comprising:

a container body having a receiving cavity and a top opening;

a lid panel pivotally coupled with said container body to pivotally move between an opened position that said lid panel is pivotally and upwardly moved away from said top opening to expose said receiving cavity and a closed position that said lid panel is pivotally and downwardly moved by gravity to cover at said top opening so as to enclose said receiving cavity; and a lid operation arrangement for driving said lid panel between said opened position and said closed position, wherein said lid operation arrangement comprises:

an automatic operated unit which comprises a sensor supported at said container body for detecting a target movement of a user;

a foot operated unit coupled at said container body for generating an upward lifting force to move said lid panel from said closed position to said opened position; and a motorized unit operatively linked with said automatic operated unit and said foot operated unit, wherein when said motorized unit is activated by said sensor, said motorized unit is arranged for generating a torque enhancing force to move said lid panel from said opened position to said closed position and for generating a decelerating force to move said lid panel back to said closed position from said opened position in a hydraulic manner, wherein after said lid panel is lifted up to said opened position by said foot operated unit that said motorized unit is idle to generate said torque enhancing force, said motorized unit only generates said decelerating force to move said lid panel back to said closed position from said opened position in a hydraulic manner, wherein said motorized unit comprises a DC power generator, a gear transmission unit which is operatively linked between said DC power generator and said lid panel for controllably lifting up and dropping down said lid panel at a speed determined by gear ratios of said gear transmission unit so as to move said lid panel between said opened and closed positions in a hydraulic manner, wherein when said lid panel is moved from said opened position to said closed position, said gear transmission unit is actuated by a downward motion of said lid panel to activate said DC power generator, such that said DC power generator generates said decelerating force, which is smaller than a gravitational force of said lid panel, to decelerate said downward motion of said lid panel.

2. The container, as recited in claim 1, wherein said motorized unit is actuated for generating a torque enhancing force to actuate said gear transmission unit so as to move said lid panel from said closed position to said opened position only when said sensor is activated.

3. The container, as recited in claim 1, wherein said motorized unit further comprises a current guider operatively coupled with said DC power generator and arranged in such a manner that when said lid panel is actuated by said foot operated unit, said current guider forms a current resistance to prevent an induction current being generated in said DC power generator, so as to enable said lid panel being moved to said opened position, and when said lid panel is moved back to said closed position, said current guider forms a current conductor to ensure said induction current being generated in said DC power generator so as to generate said decelerating force against said lid panel.

4. The container, as recited in claim 2, wherein said motorized unit further comprises a current guider operatively coupled with said DC power generator and arranged in such a manner that when said lid panel is actuated by said foot operated unit, said current guider forms a current resistance to prevent an induction current being generated in said DC power generator, so as to enable said lid panel being moved to said opened position, and when said lid panel is moved back to said closed position, said current guider forms a current conductor to ensure said induction current being generated in said DC power generator so as to generate said decelerating force against said lid panel.

5. The container, as recited in claim 2, wherein said motorized unit further comprises a current guider operatively coupled with said DC power generator and arranged in such a manner that when said lid panel is actuated by said foot operated unit, said current guider forms a current resistance to prevent an induction current being generated in said DC power generator, so as to enable said lid panel being moved to said opened position, and when said lid panel is moved back to said closed position, said current guider forms a current conductor to ensure said induction current being generated in said DC power generator so as to generate said decelerating force against said lid panel.

6. The container, as recited in claim 3, wherein said current guider is a diode electrically coupled with said DC power generator.

7. The container, as recited in claim 4, wherein said current guider is a diode electrically coupled with said DC power generator.

8. The container, as recited in claim 5, wherein said current guider is a diode electrically coupled with said DC power generator.

9. The container, as recited in claim 1, wherein said motorized unit further comprises a battery supply electrically coupled with said automatic operated unit and said motorized unit, and a switch operatively coupled with said battery supply and arranged in such a manner that when said battery supply is switched on, said lid panel is operated by said automatic operated unit, and when said battery supply is switched off, said lid panel is operated by said foot operated unit.

10. The container, as recited in claim 8, wherein said motorized unit further comprises a battery supply electrically coupled with said automatic operated unit and said motorized unit, and a switch operatively coupled with said battery supply and arranged in such a manner that when said battery supply is switched on, said lid panel is operated by said automatic operated unit, and when said battery supply is switched off, said lid panel is operated by said foot operated unit.

11. The container, as recited in claim 1, wherein said motorized unit is supported at a rear and exterior side of said container body.

12. The container, as recited in claim 10, wherein said motorized unit is supported at a rear and exterior side of said container body.

13. A container, comprising:

a container body having a receiving cavity and a top opening;

a lid panel pivotally coupled with said container body to pivotally move between an opened position that said lid panel is pivotally and upwardly moved away from said top opening to expose said receiving cavity and a closed position that said lid panel is pivotally and downwardly moved by gravity to cover at said top opening so as to enclose said receiving cavity; and a lid operation arrangement for driving said lid panel between said opened position and said closed position, wherein said lid operation arrangement comprises:

an automatic operated unit which comprises a sensor supported at said container body for detecting a target movement of a user;

a foot operated unit coupled at said container body for generating an upward lifting force to move said lid panel from said closed position to said opened position; and a motorized unit operatively linked with said automatic operated unit and said foot operated unit, wherein when said motorized unit is activated by said sensor, said motorized unit is arranged for generating a torque enhancing force to move said lid panel from said opened position to said closed position and for generating a decelerating force to move said lid panel back to said closed position from said opened position in a hydraulic manner, wherein after said lid panel is lifted up to said opened position by said foot operated unit that said motorized unit is idle to generate said torque enhancing force, said motorized unit only generates said decelerating force to move said lid panel back to said closed position from said opened position in a hydraulic manner, wherein said motorized unit comprises a DC power generator, a gear transmission unit which is operatively linked between said DC power generator and said lid panel for controllably lifting up and dropping down said lid panel at a speed determined by gear ratios of said gear transmission unit so as to move said lid panel between said opened and closed positions in a hydraulic manner, wherein said motorized unit further comprises a current guider operatively coupled with said DC power generator and arranged in such a manner that when said lid panel is actuated by said foot operated unit, said current guider forms a current resistance to prevent an induction current being generated in said DC power generator, so as to enable said lid panel being moved to said opened position, and when said lid panel is moved back to said closed position, said current guider forms a current conductor to ensure said induction current being generated in said DC power generator so as to generate said decelerating force against said lid panel.

14. The container, as recited in claim 1, wherein said motorized unit is actuated for generating a torque enhancing force to actuate said gear transmission unit so as to move said lid panel from said closed position to said opened position only when said sensor is activated.

15. The container, as recited in claim 14, wherein when said lid panel is moved from said opened position to said closed position, said gear transmission unit is actuated by a downward motion of said lid panel to activate said DC power generator, such that said DC power generator generates said decelerating force, which is smaller than a gravitational force of said lid panel, to decelerate said downward motion of said lid panel.

16. The container, as recited in claim 15, wherein when said lid panel is moved from said opened position to said closed position, said gear transmission unit is actuated by a downward motion of said lid panel to activate said DC power generator, such that said DC power generator generates said decelerating force, which is smaller than a gravitational force of said lid panel, to decelerate said downward motion of said lid panel.

17. The container, as recited in claim 13, wherein said current guider is a diode electrically coupled with said DC power generator.

18. The container, as recited in claim 14, wherein said current guider is a diode electrically coupled with said DC power generator.

19. The container, as recited in claim 15, wherein said current guider is a diode electrically coupled with said DC power generator.

20. The container, as recited in claim 13, wherein said motorized unit further comprises a battery supply electrically coupled with said automatic operated unit and said motorized unit, and a switch operatively coupled with said battery supply and arranged in such a manner that when said battery supply is switched on, said lid panel is operated by said automatic operated unit, and when said battery supply is switched off, said lid panel is operated by said foot operated unit.

21. The container, as recited in claim 19, wherein said motorized unit further comprises a battery supply electrically coupled with said automatic operated unit and said motorized unit, and a switch operatively coupled with said battery supply and arranged in such a manner that when said battery supply is switched on, said lid panel is operated by said automatic operated unit, and when said battery supply is switched off, said lid panel is operated by said foot operated unit.

22. The container, as recited in claim 13, wherein said motorized unit is supported at a rear and exterior side of said container body.

23. The container, as recited in claim 21, wherein said motorized unit is supported at a rear and exterior side of said container body.

* * * * *